US007540567B1

(12) United States Patent
Gambino

(10) Patent No.: US 7,540,567 B1
(45) Date of Patent: Jun. 2, 2009

(54) BEACH LOUNGE CHAIR

(76) Inventor: Carlo Gambino, 6694 Wisteri Dr., Myrtle Beach, SC (US) 29588

( * ) Notice: Subject to any disclaimer, the term of this patent is extended or adjusted under 35 U.S.C. 154(b) by 0 days.

(21) Appl. No.: 12/214,424

(22) Filed: Jun. 19, 2008

(51) Int. Cl.
*A47C 1/00* (2006.01)
*A47C 1/14* (2006.01)

(52) U.S. Cl. ..... 297/344.26; 248/425

(58) Field of Classification Search ..... 297/344.21, 297/344.26; 248/425
See application file for complete search history.

(56) References Cited

U.S. PATENT DOCUMENTS 4,482,184 A * 11/1984 Mincey ..... 297/344.21
4,824,170 A * 4/1989 Goldmeier ..... 297/344.26
5,046,782 A * 9/1991 Lundeen ..... 297/344.26
5,078,451 A * 1/1992 Sobel ..... 297/344.26

* cited by examiner

*Primary Examiner*—Anthony D Barfield
(74) *Attorney, Agent, or Firm*—James Ray & Assoc.

(57) ABSTRACT

A lounge chair rotatable 360 degrees and collapsible into flat position comprising a round rotatable base member having a bottom portion receiving ball bearings therein and a cover portion one of disposed over and within the bottom member and further disposed over such ball bearings. The cover rotates 360 degrees with respect to the bottom portion. A plurality of leg members are removably attachable to upper surface of the cover and extend upwardly and inwardly therefrom. A seat member is removably attachable to the plurality of leg members. A pair of arm rests are engaged on a bottom surface thereof with a removable attachment mechanism which further engages one of the upper surface of the cover and a bottom surface of the seat for removably attaching arm rests to the lounge chair. A back support member engages a removable attachment mechanism which in turn engages one of the seat and a pair of the leg members.

16 Claims, 3 Drawing Sheets

BEACH LOUNGE CHAIR

FIELD OF THE INVENTION

The present invention relates, in general, to lounge type chairs and, more particularly, this invention relates to a lounge type chair which can rotate about an axis of 360 degrees to follow the sun and, still more particularly, this invention relates to a lounge chair which is well suited for use at the beach and, still even more particularly, the invention relates to a lounge type chair which can rotate about an axis of 360 degrees to follow the sun and which is collapsible to make it easy to transport.

BACKGROUND OF THE INVENTION

Prior to the conception and development of the present invention, as is generally well known in the prior art, lounge chairs have been in widespread use for many years. Such prior art type lounge chairs come in a variety of shapes and sizes. Some of these lounge chairs may be provided with cushions while other less costly lounge chairs are not.

It is also well known to carry lounge chairs to sit in while at the beach. These lounge chairs are normally made with an aluminum frame and plastic fabric to reduce the weight.

Applicant is not aware of any type lounge chair available on the market today which is capable of rotating about an axis to maintain a desirable position with respect to the sun, thus requiring somewhat constant movement of the prior art type lounge chair to take advantage of the sunlight.

Further, when such prior art type lawn chairs are used at a sporting event consumers find it necessary to turn and stretch to enjoy the action of such event.

SUMMARY OF THE INVENTION

The present invention provides a lounge chair capable of rotating 360 degrees and collapsing into a relatively flat position for transporting. Such lounge chair includes a generally round rotatable base member. The base member has a bottom portion capable of receiving a plurality of ball bearings therein and a cover portion one of disposed over such bottom member and within such bottom member. The cover portion is further disposed over such ball bearings. Additionally, the cover portion is capable of rotating about a 360 degree arc with respect to such bottom portion. There are a predetermined plurality of leg members removably attachable at a first end thereof to an upper surface of such cover portion. These leg members extend upwardly and inwardly from the cover portion for a predetermined distance. A seat member having a first predetermined configuration is removably attachable to a second end of such predetermined plurality of leg members. A pair of arm rests, having a second predetermined configuration, are provided which engage a first removable attachment means adjacent a bottom surface of each of such arm rests. Such first removable attachment means further engages one of the upper surface of such cover portion and a bottom surface of such seat member for removably attaching the arm rests to such lounge chair. A back support member, having a third predetermined configuration, is provided. Such back support member is engageable with a second removable attachment means which in turn engages one of such seat member and a preselected pair of such plurality of leg members for removably attaching such back support member to such lounge chair.

OBJECTS OF THE INVENTION

It is, therefore, one of the primary objects of the present invention to provide a lounge chair capable of rotating 360 degrees and collapsing into a relatively flat position for transporting.

Another object of the present invention is to provide a lounge chair capable of rotating 360 degrees and collapsing into a relatively flat position for transporting which is relatively light weight.

Still another object of the present invention is to provide a lounge chair capable of rotating 360 degrees and collapsing into a relatively flat position for transporting which is relatively comfortable to sit in.

Yet another object of the present invention is to provide a lounge chair capable of rotating 360 degrees and collapsing into a relatively flat position for transporting which can be produced from a variety of materials and in a variety of colors.

An additional object of the present invention is to provide a lounge chair capable of rotating 360 degrees and collapsing into a relatively flat position for transporting which may further include many accessories selected from the group consisting of cup holder, cigarette holder, sun visor, head rest and foot rest.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
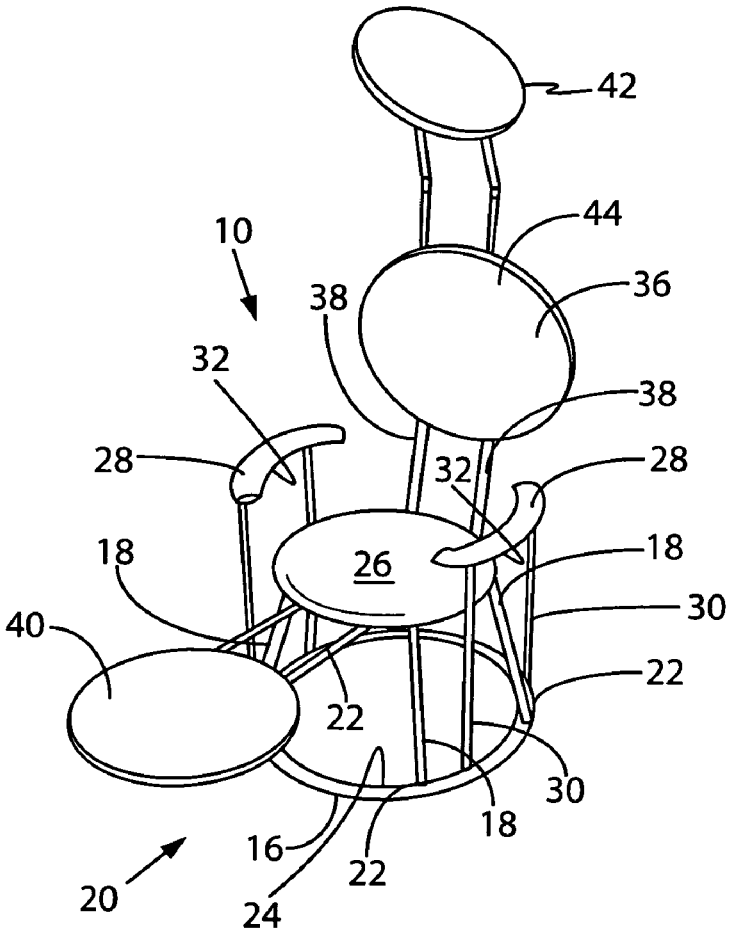
FIG. 1 is a perspective view showing a presently preferred embodiment of the rotatable lounge chair in a generally upright position.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing Figures.

Figure 2:
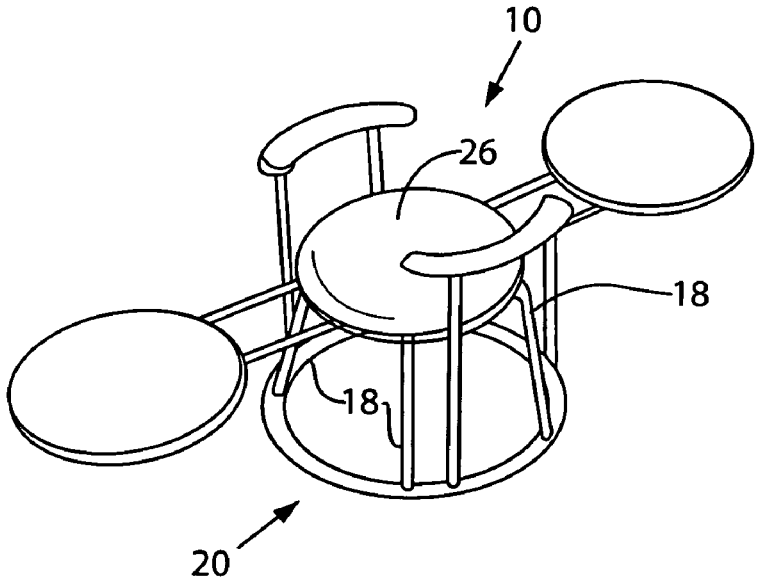
FIG. 2 is a perspective view of the rotatable lounge chair illustrated in FIG. 1 in a reclining position.
Figure 3:
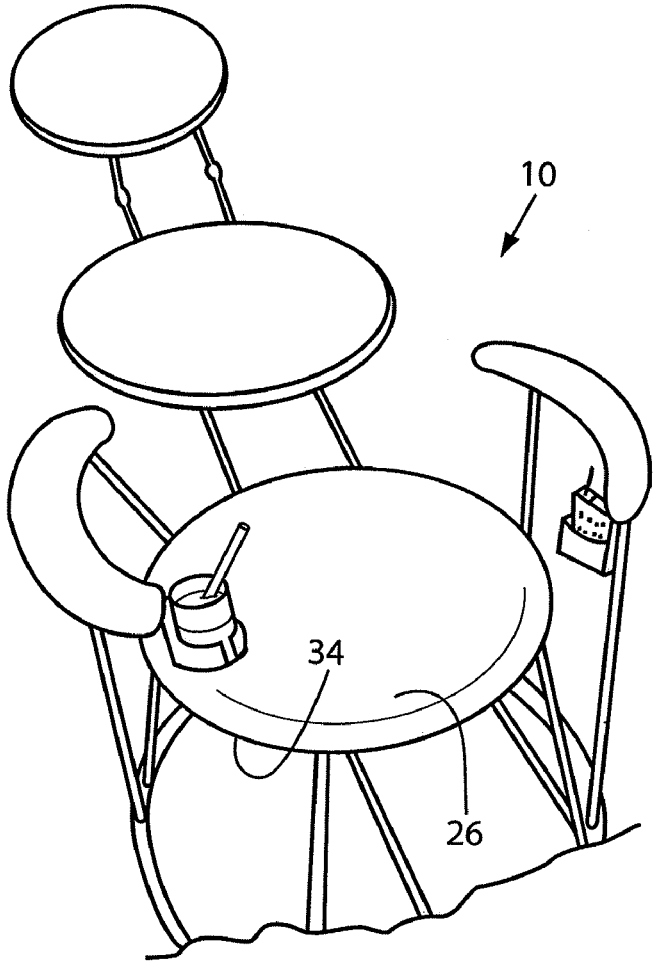
FIG. 3 is a partial view of the rotatable lounge chair shown in FIGS. 1 and 2 with selected attachments for the arms.
Figure 5:
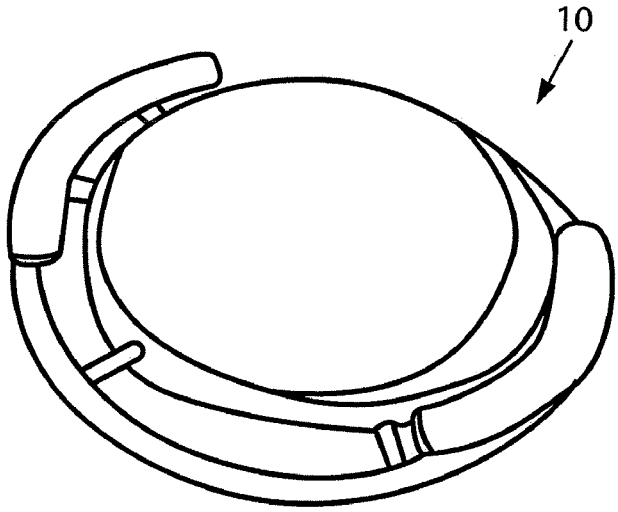
FIG. 5 is a plan view of the rotatable lounge chair illustrated in FIGS. 1-3 in a collapsed condition for carrying.
Figure 4:
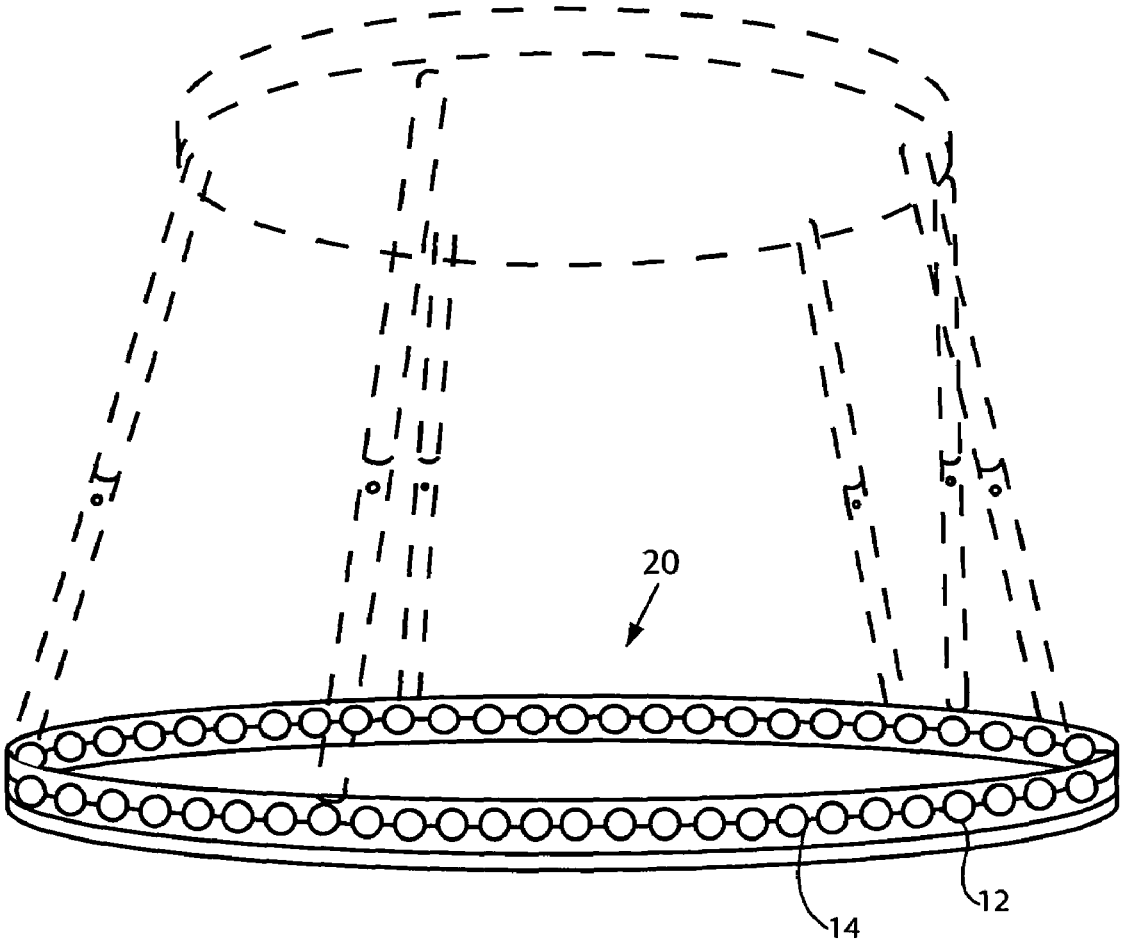
FIG. 4 is a plan view of the rotating mechanism for the rotatable lounge chair illustrated in FIGS. 1-3.
Figure 6:
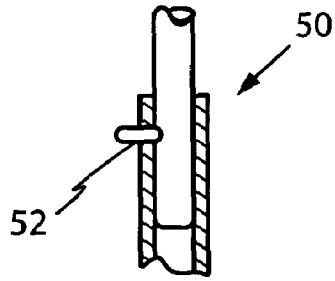
FIG. 6 is a partial view illustrating a presetly preferred adjustment means for adjusting positions of various components of the lounge chair constructed according to the invention.

Reference is now made, more particularly, to FIGS. 1-5. Illustrated therein is a lounge chair, generally designated 10, which is capable of being rotated 360 degrees about an axis and, additionally, collapsing into a relatively flat position for transporting. Such lounge chair 10 including a generally round rotatable base member, generally designated 20, having a bottom portion 12 capable of receiving a plurality of ball bearings 14 therein and a cover portion 16 one of disposed over the bottom portion 12 and within said bottom portion 12 and further disposed over such ball bearings 14. The cover portion 16 is capable of rotating about a 360 degree arc with respect to such bottom portion 12.

There are a predetermined plurality of leg members 18 removably attachable at a first end 22 thereof to an upper surface 24 of such cover portion 16 and extending upwardly and inwardly therefrom for a predetermined distance.

A seat member 26, having a first predetermined configuration, is removably attachable to a second end 28 of such predetermined plurality of leg members 18. The lounge chair 10 further includes a pair of arm rests 28, having a second predetermined configuration.

A first removable attachment means 30 engageable with a bottom surface 32 of each of such arm rests 28 and either one of such upper surface 24 of such cover portion 16 or a bottom surface 34 of such seat member 26 for removably attaching the arm rests 28 to the lounge chair 10. The first removable attachment means 30 engages a bottom surface 32 of each of the arm rests 28 and the upper surface 24 of such cover portion 16 of the base member 20. Lounge chair 10 further includes a back support member 36. Back support member 36 has a third predetermined configuration.

A final essential element of the lounge chair 10 is a second removable attachment means 38 engageable with such back support member 36 and such one of the seat member 26 and a preselected pair of plurality of leg members 18 for removably attaching the back support member 36 to such lounge chair 10.

In the presently preferred embodiment of the invention, the lounge chair 10 further includes a foot rest 40. Foot rest 40 has a fourth predetermined configuration and is removably engageable with such seat member 26. The presently preferred embodiment also includes a visor member 42 which has a fifth predetermined configuration and is also removably attached to the back support member 36.

Preferably, although not limited thereto, each of the first predetermined configuration, the third predetermined configuration, the fourth predetermined configuration and the fifth predetermined configuration are generally round. Further, the second predetermined configuration of such arm rests 28 is generally arcuate. It is likewise presently preferred that the back support member 36 further includes a head rest portion 44 disposed adjacent a top portion thereof. In this embodiment it is possible for the third predetermined configuration of such back rest 36 to be one of generally round, generally rectangular and generally oblong.

At least one of the seat member 26, the back support member 36, the arm rests 28 and the foot rest 40 of the lounge chair 10 is padded. Preferably, each of the seat member 26, the back support member 36, the arm rests 28 and the foot rest 40 are padded.

Lounge chair 10 further includes an adjustment means, generally designated 50, engageable with back support member 36 for adjusting a position of back support member 36 to different heights to suit a height of a user of the lounge chair 10. Preferably, the adjustment means 50 for adjusting a position of the back support member 36 to different heights includes a locking pin arrangement 52. It is also presently preferred, that the foot rest 40 can be raised and lowered as desired.

Preferably, the lounge chair 10 further includes an adjustment means 50 engageable with each one of the arm rest members 28 for adjusting a position of such arm rests 28 to different heights to suit a height of a user of lounge chair 10. Such adjustment means 50 for adjusting a position of the arm rests 28 to different heights also includes a locking pin arrangement 52. Further, lounge chair 10 further includes an adjustment means 50 engageable with the visor member 42 for adjusting a position of the visor member 42 to different positions as desired.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. A lounge chair capable of rotating 360 degrees and collapsing into a relatively flat position for transporting, said lounge chair comprising:

(a) a generally round rotatable base member having a bottom portion capable of receiving a plurality of ball bearings therein and a cover portion one of disposed over said bottom portion and within said bottom portion and further disposed over said ball bearings, said cover portion capable of rotating about a 360 degree arc with respect to said bottom portion;

(b) a predetermined plurality of leg members removably attachable at a first end thereof to an upper surface of said cover portion and extending upwardly and inwardly therefrom for a predetermined distance;

(c) a seat member, having a first predetermined configuration, removably attachable to a second end of said predetermined plurality of leg members;

(d) a pair of arm rests, having a second predetermined configuration;

(e) a first removable attachment means engageable with a bottom surface of each of said arm rests and one of said upper surface of said cover portion and a bottom surface of said seat member for removably attaching said arm rests to said lounge chair;

(f) a back support member, having a third predetermined configuration; and (g) a second removable attachment means engageable with said back support member and said one of said seat member and a preselected pair of said plurality of leg members for removably attaching said back support member to said lounge chair.

2. A lounge chair, according to claim 1, wherein said lounge chair further includes a foot rest, having a fourth predetermined configuration, removably engageable with said seat member.

3. A lounge chair, according to claim 2, wherein said lounge chair further includes a visor member, having a fifth predetermined configuration, removably attached to said back support member.

4. A lounge chair, according to claim 3, wherein each of said first predetermined configuration, said third predetermined configuration, said fourth predetermined configuration and said fifth predetermined configuration are generally round.

5. A lounge chair, according to claim 3, wherein said lounge chair further includes an adjustment means engageable with said visor member for adjusting a position of said visor member to different positions as desired.

6. A lounge chair, according to claim 2, wherein said foot rest can be raised and lowered as desired.

7. A lounge chair, according to claim 1, wherein said second predetermined configuration of said arm rests is generally arcuate.

8. A lounge chair, according to claim 1, wherein said back support member further includes a head rest portion.

9. A lounge chair, according to claim 8, wherein said third predetermined configuration of said back rest is one of generally round, generally rectangular and generally oblong.

10. A lounge chair, according to claim 1, wherein at least one of said seat member, said back support member, said arm rests and said foot rest is padded.

11. A lounge chair, according to claim 10, wherein each of said seat member, said back support member, said arm rests and said foot rest are padded.

12. A lounge chair, according to claim 1, wherein said first removable attachment means engages a bottom surface of each of said arm rests and said upper surface of said cover portion of said base member.

13. A lounge chair, according to claim 1, wherein said lounge chair further includes an adjustment means engageable with said back support member for adjusting a position of said back support member to different heights to suit a height of a user of said lounge chair.

14. A lounge chair, according to claim 13, wherein said adjustment means for adjusting a position of said back support member to different heights includes a locking pin arrangement.

15. A lounge chair, according to claim 1, wherein said lounge chair further includes an adjustment means engageable with each one of said arm rest members for adjusting a position of said arm rests to different heights to suit a height of a user of said lounge chair.

16. A lounge chair, according to claim 15, wherein said adjustment means for adjusting a position of said arm rests to different heights includes a locking pin arrangement.

* * * * *